US008926225B2

(12) United States Patent
Aboumalwa

(10) Patent No.: US 8,926,225 B2
(45) Date of Patent: Jan. 6, 2015

(54) LEG MATING UNIT

(71) Applicant: J. Ray McDermott, S.A., Houston, TX (US)

(72) Inventor: Mohamed Aboumalwa, Sharjah (AE)

(73) Assignee: J. Ray McDermott, S.A., Houston, TX (US)

( * ) Notice: Subject to any disclaimer, the term of this patent is extended or adjusted under 35 U.S.C. 154(b) by 0 days.

(21) Appl. No.: 13/845,557

(22) Filed: Mar. 18, 2013

(65) Prior Publication Data

US 2014/0270976 A1 Sep. 18, 2014

(51) Int. Cl.
*E02B 17/00* (2006.01)
*E02B 17/02* (2006.01)

(52) U.S. Cl.
CPC ..... *E02B 17/0017* (2013.01); *E02B 17/02* (2013.01); *E02B 17/024* (2013.01)
USPC ..... 405/204; 405/203; 405/205

(58) Field of Classification Search
USPC ..... 405/200, 203, 204, 205, 206, 209
See application file for complete search history.

(56) References Cited

U.S. PATENT DOCUMENTS 4,413,926 A * 11/1983 Ninet ..... 405/204
4,436,454 A * 3/1984 Ninet et al. ..... 405/204
4,607,982 A * 8/1986 Brasted et al. ..... 405/204
4,729,695 A * 3/1988 Silvestri ..... 405/204
4,761,097 A * 8/1988 Turner ..... 405/204
4,848,967 A * 7/1989 Weyler ..... 405/204
4,930,938 A * 6/1990 Rawstron et al. ..... 405/204
5,219,451 A * 6/1993 Datta et al. ..... 405/204
5,522,680 A * 6/1996 Hoss et al. ..... 405/209
6,027,287 A * 2/2000 Faldini ..... 405/209
6,648,553 B2 * 11/2003 Rolfsnes ..... 405/209
6,981,823 B2 * 1/2006 Roraas et al. ..... 405/204
8,573,891 B2 * 11/2013 Horton et al. ..... 405/205
2009/0016822 A1 * 1/2009 Maher et al. ..... 405/205
2011/0314750 A1 * 12/2011 Nies ..... 52/173.1

* cited by examiner

*Primary Examiner* — Benjamin Fiorello
(74) *Attorney, Agent, or Firm* — D. Neil LaHaye

(57) ABSTRACT

A leg mating unit for installation of offshore structures. A housing has a ram movably mounted in the housing. Elastomeric material is received in the housing immediately below the ram. An open space below the elastomeric material is filled with a disposable, granular material such as sand. A drain valve for selectively releasing the disposable material is provided on the housing. A load absorbing ring is engaged with the ram. A stop ring is rigidly mounted on the leg of the topside structure and engages the load absorbing ring during installation of the topside structure onto its lower supporting structure. The housing is removably mounted on the lower support structure such that the leg mating unit is removable and reusable.

10 Claims, 5 Drawing Sheets

LEG MATING UNIT

FIELD AND BACKGROUND OF INVENTION

The invention is generally related to the installation of topsides of offshore structures and more particularly to the leg mating units between the topsides and the supporting legs.

Traditionally, the standard methodology for installing a topside structure onto its supporting structure, whether the supporting structure is bottom founded or a floating structure, involves lowering the topside structure onto the lower supporting structure.

The topside structure may be supported on a barge or pontoons used to position the topside structure over the lower supporting structure and legs. Once in position, the barge or pontoons are ballasted down to transfer the weight of the topside to its supporting structure.

The topside may also be lifted from the barge by a crane and lowered into position on the legs of the supporting structure by the crane.

In either method of installation, the weight transfer of the topside to the supporting structure must be controlled to prevent damage to both the topside and the supporting structure. Also, the heave motion of waves acting on the barge, pontoons, or vessel on which the crane is mounted must be taken into account to prevent damage to the topside and its lower support structure by repeated contact due to wave action. In order to eliminate or greatly reduce the chances for damage to the topside and legs of the lower support structure, it is preferable to quickly transfer a predetermined portion of the load of the topside onto the legs of the lower support structure. This serves to retain contact between the two structures and prevent damage that would occur due to wave action causing repeated contact. Because topsides structures can weigh as much as 80,000 tons, the full load cannot be immediately transferred. Otherwise, significant damage would occur to the supporting structure. After the initial transfer to insure that contact is maintained, the transfer of the remaining weight is done in a controlled manner.

This has typically been addressed in the offshore construction industry by the use of sacrificial leg mating units (LMUs).

The sacrificial LMUs have been mounted on the inside of the legs of the lower support structure and been a crushable material such as elastomeric material that is designed to absorb the initial load and then progressively crush as the remainder of the topside load is transferred. As a result of the size and weight of the structures involved, and the forces that must be dealt with, a single LMU can cost as much as one million dollars or more, and larger offshore structures can require as many as twelve LMUs during installation. Because the load absorbing characteristic of the LMUs is destroyed, and the LMUs have been an integral member of the legs, they are not reusable.

It is seen from the above that a more cost and material efficient means of achieving the same result is desirable in the offshore construction and installation industry.

SUMMARY OF INVENTION

The present invention addresses the shortcomings in the prior art by providing a less costly LMU structure and installation method. One or more LMUs (leg mating units) are attached to each of one or more legs of a lower support structure, such as a jacket, for the topside. The LMUs absorb the load of a topside as it is installed onto a lower support structure. A stop ring is rigidly attached around the outer diameter of the lower end of corresponding legs of the topside. An LMU assembly ring is attached around the upper end of the LMUs and is sized to receive the stop ring during installation of the topside onto the lower support structure. The LMUs include a plunger and material for absorbing the load of the topside on the lower structure. The LMUs are attached to the outside of the leg structure to allow removal and reuse of the LMUs.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

Figure 1:
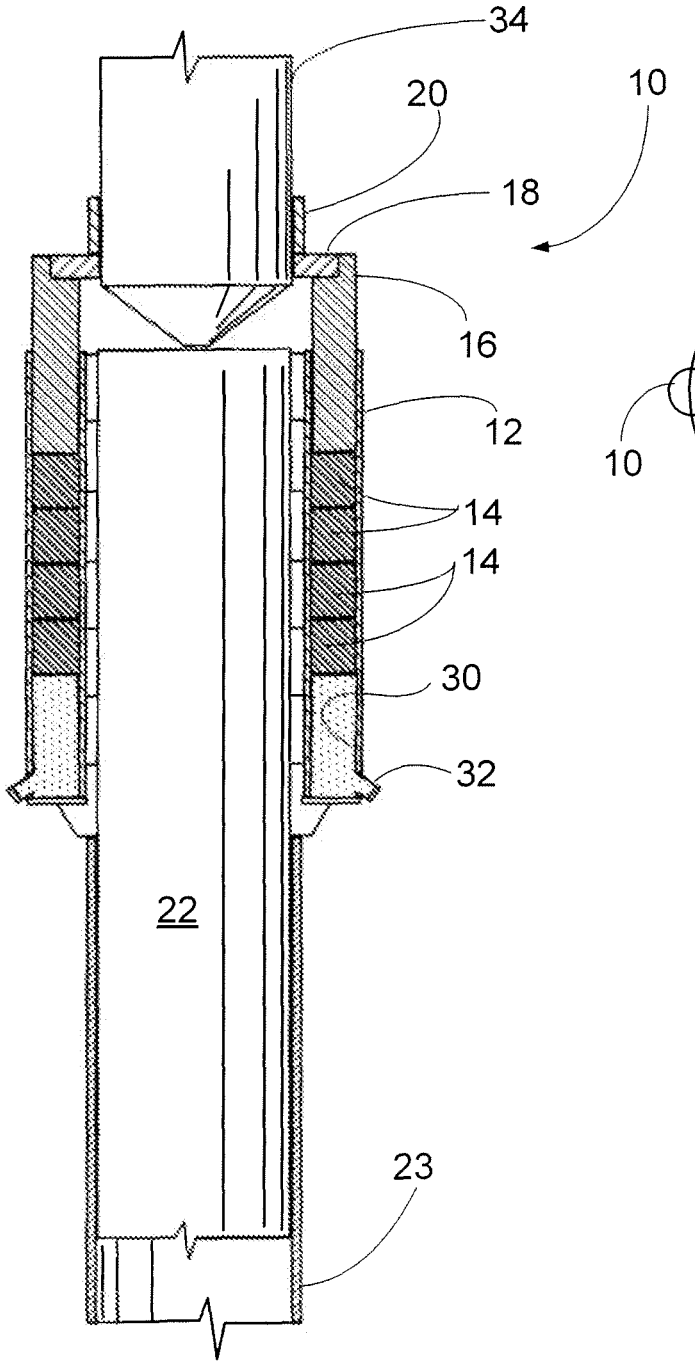
FIG. 1 is a side sectional view of the invention.
Figure 2:
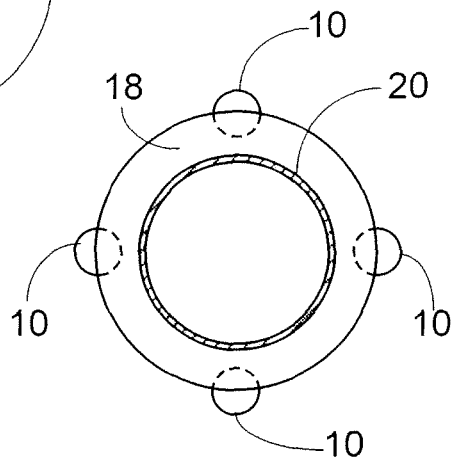
FIG. 2 is a plan view of the invention.

As seen in FIGS. 1 and 2, the leg mating unit 10 of the invention is generally comprised of a housing 12, elastomeric material 14, a ram 16, a load absorbing ring 18, and a stop ring 20.

Figure 3:
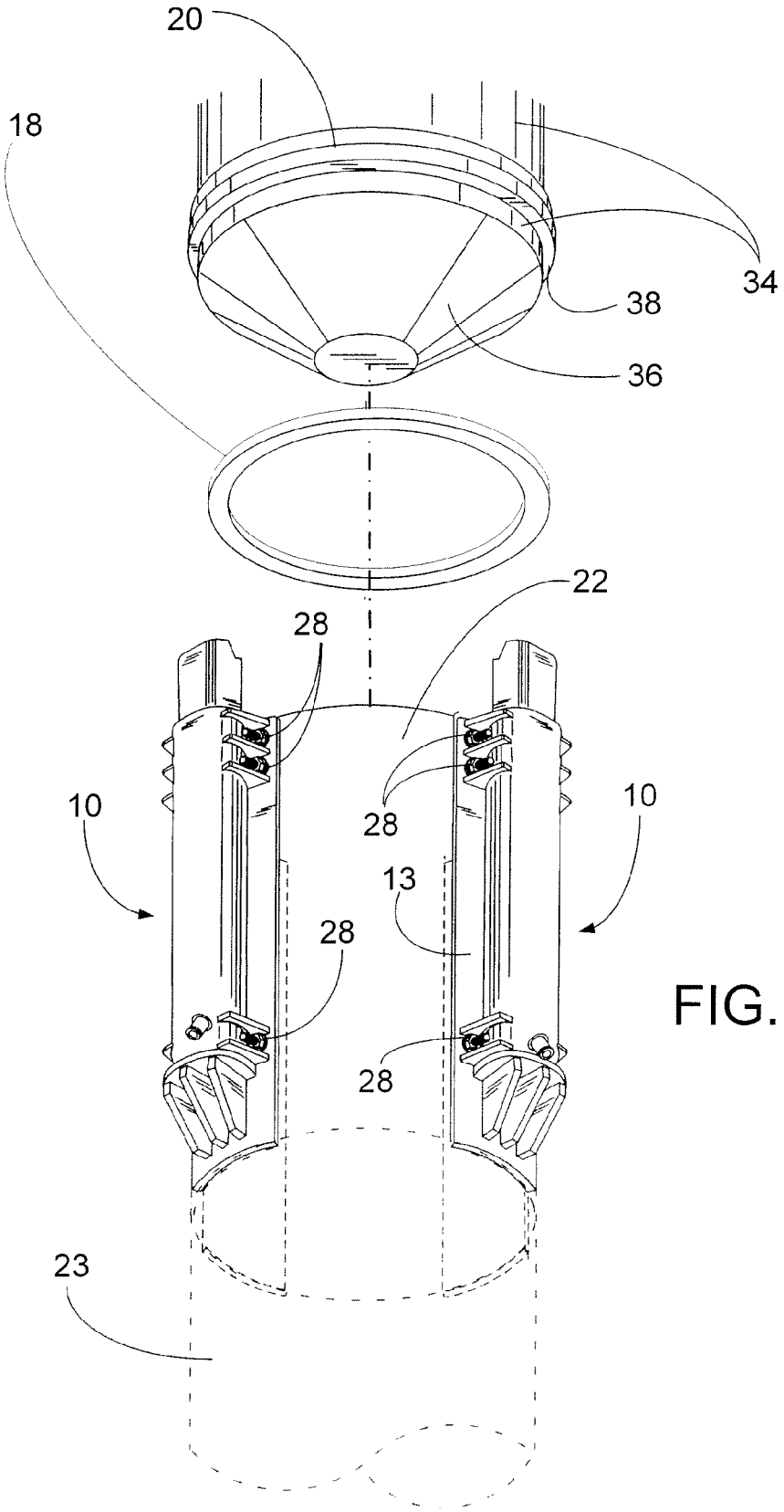
FIG. 3 is a perspective view of the leg mating units attached to the piling or leg of the lower support structure for a topside structure.
Figure 4:
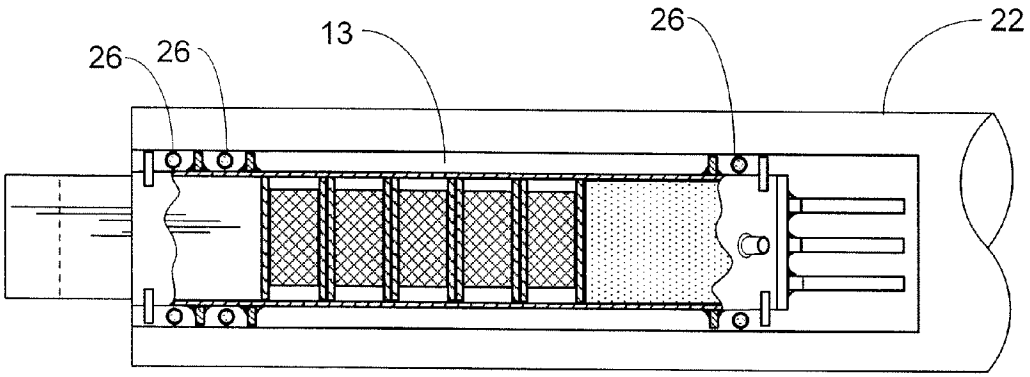
FIGS. 4 and 5 are enlarged detailed views that illustrate the attachment of the leg mating units to the piling or leg of the lower support structure for a topside structure.
Figure 5:
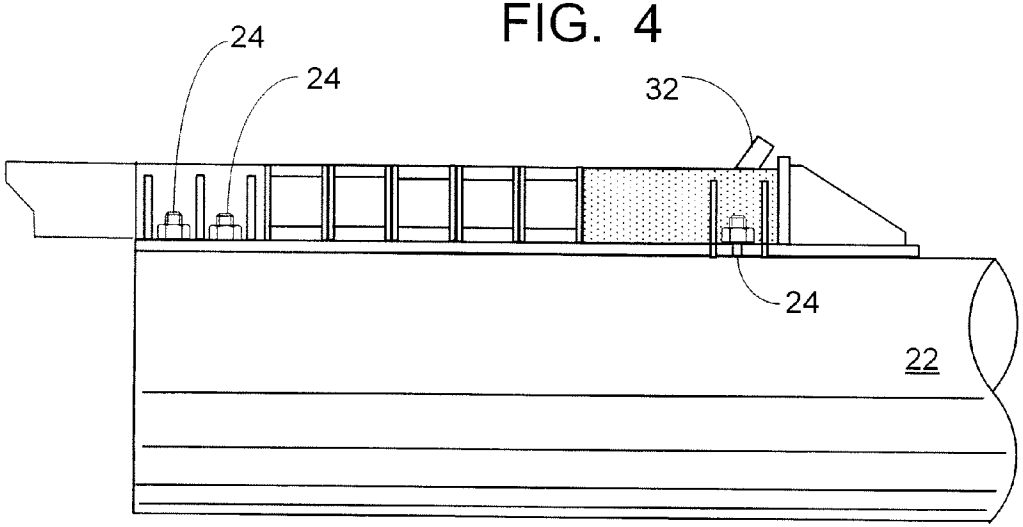

As seen in FIGS. 3 and 4, the housing 12 includes flanges 13 for mounting on the piling 22. The leg mating unit 10 is preferably mounted on the piling 22 by the use of studs or bolts 24, seen in FIG. 5, on the piling 22 that are received through mounting holes 26 on the housing 12 and secured by nuts 28. The use of studs or bolts allows for easy removal of the leg mating unit 10 after installation of a topside on its lower supporting structure. The housing 12 may also be mounted to the piling 22 by any suitable means such as welds which are cut after installation of the topside for removal of the leg mating unit 12.

FIGS. 1 and 3 illustrate the piling 22 received in the leg 23 of the lower support structure for the topside. It should be understood that, in some situations, the leg mating unit 10 may be mounted to a leg of the lower support structure instead of a piling. Thus, the phrase tubular member of the lower support structure may be used to refer to either the piling or leg.

As seen in FIG. 3, the leg 34 of the topside has a tapered lower end 36 for ease of insertion into the piling 22. Adjacent the tapered end 36 is a lip 38 that has a diameter sized to rest on the piling 22 after the full load of the topside has been transferred to the pilings 22 or legs 23 of its lower support structure.

As seen in FIG. 1, the elastomeric material 14 does not take up all of the space in the housing 12 when initially set up for installation of a topside structure. It is preferable that more than one layer of elastomeric material 14 be used for ease of selectively tuning the compression rate during operation and more consistent compression of the elastomeric material 14. There is an open space 30 below the elastomeric material 14 when in the initial configuration before use. The open space 30 is used to hold a loose, granular, disposable material such as sand. The lower end of the housing 12 also includes a drain valve 32 for selectively allowing release of the disposable material at the desired stage of the topside installation procedure.

A plurality of layers of elastomeric material 14 is preferably used for selectively adjusting the load absorption and compression characteristics to match the weight of the topside being installed. The elastomeric material 14 may be of any type suitable for absorbing large loads. Such elastomeric materials are well known in the offshore installation industry.

Figures 6, 7, 8:
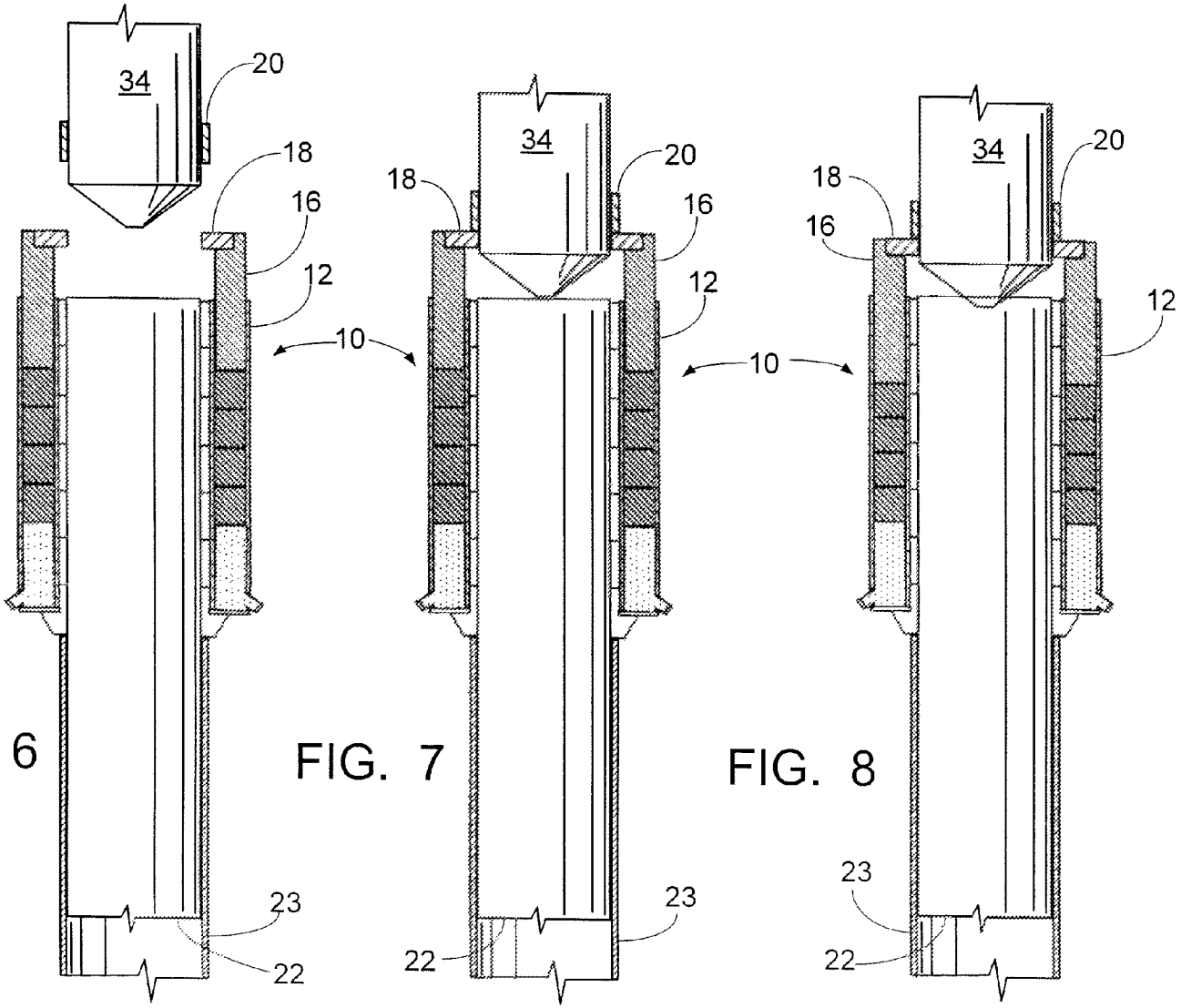
FIG. 6-11 illustrate the sequence of installing a topside using the invention.

Ram 16 has an exterior diameter that closely matches the interior diameter of the housing and is movably received in the housing 12. The ram 16 is in the initial installation configuration/position as seen in FIGS. 1, 6, and 7. As seen in FIGS. 1 and 6-11, the lower end of the ram 16 is in contact with the elastomeric material 14 during the initial installation configuration/position and throughout the installation procedure.

The load absorbing ring 18 is either received on or rigidly attached to the ram 16 of each of the leg mating units 12 mounted on the piling 22 or jacket leg. As seen in FIG. 1 the inner diameter of the load absorbing ring 18 closely matches the outer diameter of the topside leg 34 to be installed for receiving the topside deck leg 34.

The stop ring 20 (best seen in FIGS. 1, 3 and 6-11) is rigidly mounted, by any means such as welding, adjacent the lower end of the topside leg 34, but above lip 38, such that the outer diameter of the stop ring 20, as mounted on the deck leg 34, is greater than the inner diameter of the load absorbing ring 18 and lip 38. Thus, the topside deck leg 34 is received through the load absorbing ring 18 only up to the point where the stop ring 20 contacts the load absorbing ring 18.

In operation, the barge or pontoons (hereinafter referred to as "installation vessel") supporting the topside is floated into a position such that the topside is above the lower supporting structure onto which the topside will be lowered. The legs 34 of the topside and the tubular members 22 of the lower supporting structure having leg mating units 10 are aligned as seen in FIGS. 3 and 6.

As seen in FIG. 7 the installation vessel is ballasted downward to cause the stop ring 20 on the leg 34 of the topside to engage the shoulder of the load absorbing ring 18 and the legs 34 of the topside then enter the piling 22 or leg 23 of the lower support structure. There is zero percent load transfer in FIG. 7.

Once contact of the stop ring 20 with the load absorbing ring 18 is made, the speed of the downward ballasting is preferably increased a predetermined amount to insure that the topside and lower support structure maintain contact to prevent damaging impacts that could result from rising and falling wave action. FIG. 8 illustrates one hundred percent load transfer of the topside onto its lower support structure as seen by the movement of the ram 16 and the compression of the elastomeric material 14. The elastomeric material 14 is fully compressed and supporting the topside on its lower support structure.

Figures 9, 10, 11:
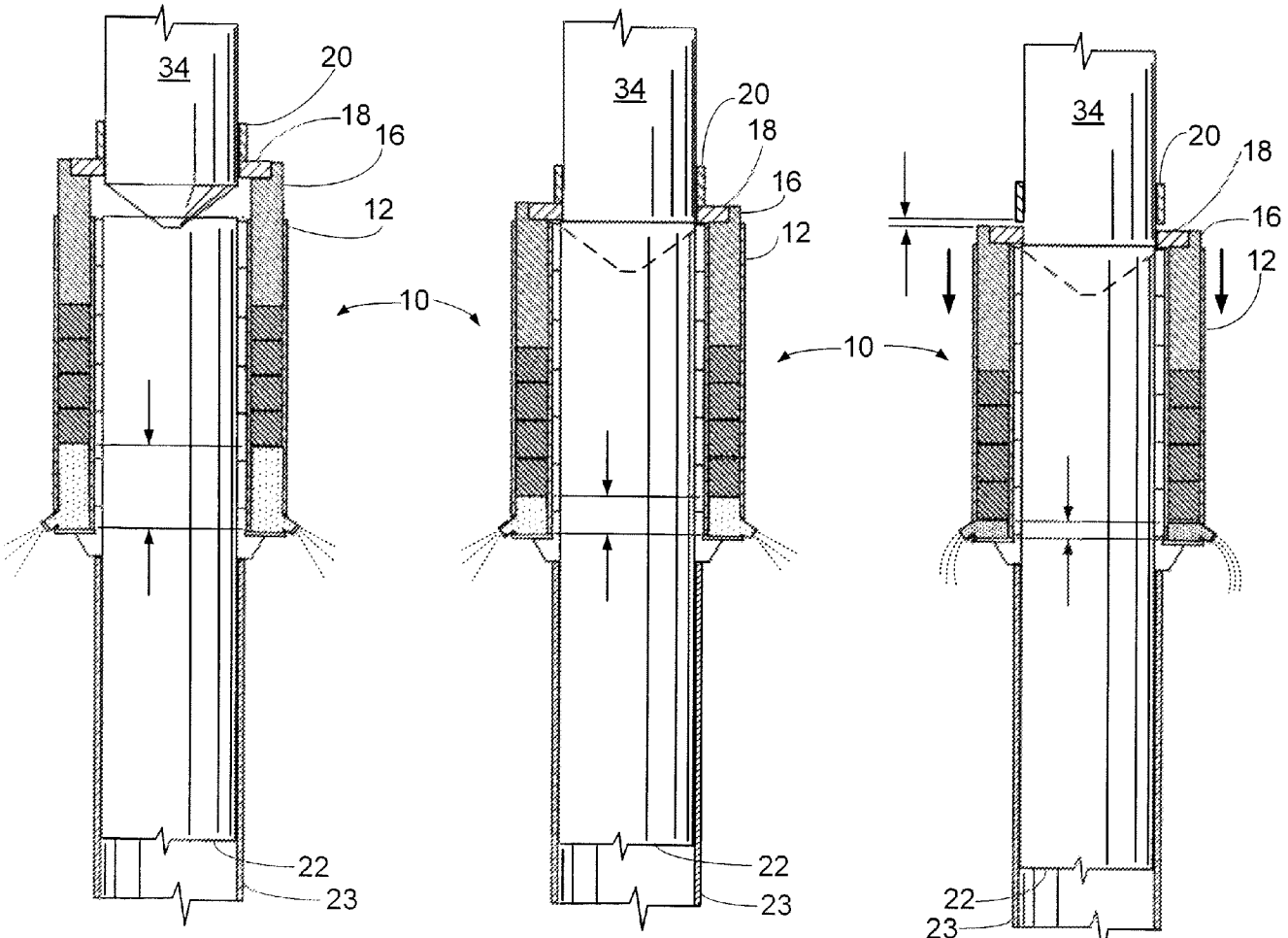

After the one hundred percent load transfer illustrated in FIG. 8, the drain valves 32 are opened. The pressure from the compressed elastomeric material 14 causes the disposable material, preferably sand, to flow out of the housing 12 as illustrated in FIG. 9-11.

This releases the pressure on the elastomeric material 14 and allows the ram 16 and elastomeric material to move downward. The lip 38 of the topside leg 34 then rests on the piling 22. As seen by the space indicated by the arrows in FIG. 11, this action results in disengagement of the load absorbing ring 18 and stop ring 20, which allows for removal of the leg mating units 10. Removal is accomplished by removal of the nuts 28 from the studs or bolts 24, or other attachment means, and removing the leg mating units 10 from the studs or bolts. The leg mating units 10 may then be reused for a different topside installation. The load absorbing ring 18 and stop ring 20 may either be cut into one or more pieces for retrieval and reuse or recycling of the metal or left in place. Even if left in place, the major portion of the leg mating unit is reusable and greatly reduces the overall cost of such devices.

The invention provides a number of advantages.

The invention saves the costs of expensive, sacrificial, single use LMU's and reduces the cost of float over operations.

The invention can reduce engineering and fabrication costs for fabrication of new LMU's.

The invention can increase the flexibility of changing the configuration of LMU's, which allows an increase in offshore workability and reduced impact loadings during topside installation.

While specific embodiments and/or details of the invention have been shown and described above to illustrate the application of the principles of the invention, it is understood that this invention may be embodied as more fully described in the claims, or as otherwise known by those skilled in the art (including any and all equivalents), without departing from such principles.

What is claimed as invention is:

1. A leg mating unit for the legs of a topside structure and the legs of a the support structure for the topside structure, comprising:

a. a housing mounted on the outer perimeter of at least one leg of the support structure for the topside structure;

b. a ram movably received in the housing;

c. a layer of elastomeric material received in the housing immediately below the ram;

d. a disposable material received in the housing below the elastomeric material;

e. a stop ring rigidly attached around the outer diameter of the lower end of at least one of the legs on the topside structure; and f. a load absorbing ring that engages the ram.

2. The arrangement of claim 1, further comprising means for selectively releasing the disposable material from the housing.

3. The leg mating unit of claim 1, further comprising means for removably mounting the housing on the lower support structure for the topside structure.

4. The leg mating unit of claim 3, wherein the means for removably mounting the housing on the lower support structure for the topside structure comprises bolts.

5. The leg mating unit of claim 3, wherein the means for removably mounting the housing on the lower support structure for the topside structure comprises studs.

6. The leg mating unit of claim 3, wherein the means for removably mounting the housing on the lower support structure for the topside structure comprises welding.

7. A leg mating unit for the legs of a topside structure and the legs of a support structure for the topside structure, comprising:

a. a housing mounted on the outer perimeter of at least one leg of the lower support structure for the topside structure;

b. means for removably mounting the housing on the lower support structure for the topside structure;

c. a ram movably received in the housing;

d. a layer of elastomeric material received in the housing immediately below the ram;

e. a disposable material received in the housing below the elastomeric material;

f. a stop ring rigidly attached around the outer diameter of the lower end of at least one of the legs on the topside structure;

g. a load absorbing ring that engages the ram; and h. means for selectively releasing the disposable material.

8. The leg mating unit of claim 7, wherein the means for removably mounting the housing on the lower support structure for the topside structure comprises bolts.

9. The leg mating unit of claim 7, wherein the means for removably mounting the housing on the lower support structure for the topside structure comprises studs.

10. The leg mating unit of claim 7, wherein the means for removably mounting the housing on the lower support structure for the topside structure comprises welding.

* * * * *